US009828701B2

(12) United States Patent
Rudinger

(10) Patent No.: US 9,828,701 B2
(45) Date of Patent: Nov. 28, 2017

(54) POST-EXTRUDED POLYMERIC MAN-MADE SYNTHETIC FIBER WITH POLYTETRAFLUOROETHYLENE (PTFE)

(71) Applicant: Richard F. Rudinger, Frederick, MD (US)

(72) Inventor: Richard F. Rudinger, Frederick, MD (US)

( * ) Notice: Subject to any disclaimer, the term of this patent is extended or adjusted under 35 U.S.C. 154(b) by 0 days.

(21) Appl. No.: 14/514,716

(22) Filed: Oct. 15, 2014

(65) Prior Publication Data

US 2015/0107215 A1 Apr. 23, 2015

Related U.S. Application Data

(60) Provisional application No. 61/892,312, filed on Oct. 17, 2013.

(51) Int. Cl.

| | |
|---|---|
| ***D02G 3/00*** | (2006.01) |
| ***D02G 3/36*** | (2006.01) |
| ***D02J 3/00*** | (2006.01) |
| ***D02J 13/00*** | (2006.01) |
| ***D02J 1/22*** | (2006.01) |
| ***D06M 15/70*** | (2006.01) |
| ***D06M 15/71*** | (2006.01) |
| ***D01F 11/06*** | (2006.01) |
| ***D02G 3/04*** | (2006.01) |
| ***D02G 1/02*** | (2006.01) |
| ***D06M 15/256*** | (2006.01) |

(52) U.S. Cl.

CPC ..... *D02G 3/045* (2013.01); *D01F 11/06* (2013.01); *D02G 1/0206* (2013.01); *D02G 3/36* (2013.01); *D02J 1/22* (2013.01); *D02J 3/00* (2013.01); *D02J 13/00* (2013.01); *D06M 15/256* (2013.01); *D06M 15/70* (2013.01); *D06M 15/71* (2013.01)

(58) Field of Classification Search

CPC ..... D02G 3/045; D02G 3/36; D02G 1/0206; D02J 3/00; D02J 13/00; D02J 1/22; D06M 15/256; D06M 15/70; D06M 15/71; D01F 11/06

See application file for complete search history.

(56) References Cited

U.S. PATENT DOCUMENTS

| | | | | |
|---|---|---|---|---|
| 3,511,677 | A * | 5/1970 | Strohmaier | D01F 6/60 264/210.3 |
| 3,953,566 | A | 4/1976 | Gore | |
| 3,958,066 | A | 5/1976 | Imamura et al. | |
| 4,187,390 | A | 2/1980 | Gore | |
| 4,267,233 | A | 5/1981 | Tanaka et al. | |
| 4,420,534 | A | 12/1983 | Matsui et al. | |
| 5,067,538 | A | 11/1991 | Nelson et al. | |
| 5,352,519 | A | 10/1994 | Stevens et al. | |
| 5,387,300 | A | 2/1995 | Kitamura | |
| 5,871,816 | A | 2/1999 | Tal | |
| 5,890,272 | A | 4/1999 | Liberman et al. | |
| 5,939,340 | A | 8/1999 | Gabbay | |
| 5,981,066 | A | 11/1999 | Gabbay | |
| 6,068,805 | A | 5/2000 | Lockridge et al. | |
| 6,124,221 | A | 9/2000 | Gabbay | |
| 6,143,368 | A | 11/2000 | Gunn | |
| 6,228,922 | B1 | 5/2001 | Wang et al. | |
| 6,482,424 | B1 | 11/2002 | Gabbay | |
| 7,169,402 | B2 | 1/2007 | Gabbay | |
| 7,296,690 | B2 | 11/2007 | Gabbay | |
| 7,364,756 | B2 | 4/2008 | Gabbay | |
| 7,491,791 | B2 | 2/2009 | Cody et al. | |
| 7,700,716 | B2 | 4/2010 | Cunningham et al. | |
| 7,968,190 | B2 | 6/2011 | Clough | |
| 8,075,993 | B2 | 12/2011 | Clough et al. | |
| 8,183,167 | B1 | 5/2012 | Delattre et al. | |
| 8,485,456 | B2 | 7/2013 | Gryaznov et al. | |
| 2003/0175514 | A1 | 9/2003 | Hancock et al. | |
| 2004/0053049 | A1 | 3/2004 | Tsunashima et al. | |
| 2004/0267313 | A1 | 12/2004 | Amery et al. | |
| 2005/0100733 | A1 | 5/2005 | Foss et al. | |
| 2005/0142969 | A1 | 6/2005 | Yu et al. | |
| 2005/0181206 | A1 | 8/2005 | Endo et al. | |
| 2006/0033231 | A1 | 2/2006 | Reuter | |
| 2008/0152905 | A1 | 6/2008 | Hendriks et al. | |
| 2010/0043382 | A1 | 2/2010 | Kriele et al. | |
| 2012/0164449 | A1 | 6/2012 | Foss | |
| 2012/0184166 | A1* | 7/2012 | Kurihara | 442/181 |

FOREIGN PATENT DOCUMENTS

| | | |
|---|---|---|
| AU | 2004/207816 | 8/2004 |
| DE | 4403016 | 8/1995 |
| EP | 116865 | 8/1984 |
| EP | 253663 | 1/1988 |
| EP | 0327736 | * 2/1988 |
| EP | 0 269 850 | 6/1988 |

(Continued)

OTHER PUBLICATIONS

KR100389049B1, Mun, Jun. 13, 2003.*

Summary of Labeling Requirements, http://www.fda.gov/Cosmetics/Labeling/Regulations/ucm126438.htm Oct. 1991; updated Jun. 18, 2009.

EPA 735-F-03-006, Consumer Products Treated with Pesticides, http://www.epa.gov/pesticides/factsheets/treatart.htm Current as of Aug. 2003.

Cosmetic Labeling Guide, http://www.fda.gov/cosmetics/labeling/regulations/ucm126444.htm Page Last Updated: Sep. 18, 2014.

Xing et al., An EFE Model on Skin-Sleeve Interactions During Arm Rotation, Transactions of the ASME, vol. 128, Dec. 2006, pp. 872-878.

Sinha et al., Fibres of 21st Century, http://www.fibre2fashion.com/industry-article/pdffiles/Fibres-of-21st-Century.pdf?PDFPTOKEN=5ba9e4f03da608f3d329a7c45345d26f294c3886%7C1225015537 downloaded from the internet on Oct. 28, 2014.

(Continued)

*Primary Examiner* — Amina Khan

(74) *Attorney, Agent, or Firm* — Leveque IP Law, P.C.

(57) ABSTRACT

A method of producing synthetic yarn having polytetrafluoroethylene (PTFE) properties is described. The method providing: applying a PTFE additive to a partially oriented yarn (POY) during one or more finishing processes of the POY to produce a PTFE enhanced POY having PTFE on the surface of the fibers of the PTFE enhanced POY.

14 Claims, 4 Drawing Sheets

(56) References Cited

FOREIGN PATENT DOCUMENTS

| | | |
|---|---|---|
| EP | 0 327 736 | 8/1989 |
| EP | 427858 | 5/1991 |
| JP | 01-046465 | 2/1989 |
| JP | 01-246204 | 10/1989 |
| JP | 03-113011 | 5/1991 |
| WO | WO 94/15463 | 7/1994 |
| WO | WO 03/031700 | 4/2003 |
| WO | WO 2004/030880 | 4/2004 |
| WO | WO 2004/031458 | 4/2004 |

OTHER PUBLICATIONS

History of Fabrics, http://www.textileschool.com/articles/339/history-of-fabrics Textile School Articles, downloaded from the internet on Oct. 28, 2014.
The History of PTFE, http://www.ppstechnology.com/Assets/PDF/PTFEHistory.pdf downloaded from the internet on Oct. 28, 2014.
USPTO, PCT/US2014/060608, PCT International Search Report, dated Dec. 24, 2014.
USPTO, PCT/US2014/060601, PCT International Search Report, Dec. 24, 2014.
Apparelsearch.com, "Synthetic Fiber Definition", www.apparelsearch.com/definitions/fiber/synthetic_fibers.htm, Jun. 1, 1997.
Wikipedia, "Aramid", https://en.wikipedia.org/wiki/Ararmid , Jul. 17, 2003.
http://uim.avko.bg , PTFE products, https://web.archive.org/web/20120115000000*/http://uim.avko.bg/english/homeEn , Feb. 28, 2012.
Fibersource, "Bicomponent Fiber", https://web.archive.org/web/20010429052523/http://www.fibersource.com/f-tutor/bicomponent.htm , Apr. 29, 2001.
Raghavendra et al., "Bicomponent Fibers", http://www.engr.utk.edu/mse/Textiles/Bicomponent%20fibers.htm , Apr. 1, 2004.
Centexbel, "Bicomponent Fibres", https://web.archive.org/web/20101209001544/http://www.centexbel.be/bicomponent-fibres , Dec. 9, 2010.
Dugan, Jeffrey, "Specialty Markets-Bicomponent Fibers", http://www.textileworld.com/Issues/2010/July-August/Nonwovens-Technical_Textiles/Specialty_Markets_--Biocomponent_Fibers , Jul. 1, 2010.
Calvosealing, ICP 907, info@calvosealing.com , Dec. 3, 2012.
Wilson, Doug, "Dyes and Dyeing Glossary", definitions for binder, ionic bond, covalent bond, https://www.academia.edu/8527386/NOTE_Dyes_and_Dyeing_Glossary_A_Glossary_of_Terms_for_Materials_and_Processes_in_Textile_Dyeing_for_Artists , Jan. 1, 2004.
Fabriclink, Textile Dictionary, https://web.archive.org/web/20061015171137/http://www.fabriclink.com/Dictionaries/Textile.cfm , Oct. 15, 2006.
Gore Technologies Worldwide, "GFO Packing Fiber", https://web.archive.org/web/20050113213220/http://www.gore.com/en_xx/products/sealants/packing/gfo_packing_fiber.html , Jan. 13, 2005.
HMS Co., "PTFE Shapes", https://web.archive.org/web/20120509105534/http://www.houmfg.com/products/ptfe.php , May 9, 2012.
Industrial Packing Inc., Graphite/PTFE Finish Packings, https://web.archive.org/web/20090111122957/http://www.industrialpacking.com/graphite_yarn , Jan. 11, 2009.
Textilelearner blog, "What is Textile Fiber?", http://textilelearner.blogspot.com/2012/02/what-is-textile-fiber-types-of-textile.html , Feb. 1, 2012.
Toray, "Mechanical Packing Yarns", http://www.torayfluorofibers.com/Default.aspx?tabid=67 , Jan. 1, 2007.
Warwick Mills, "Textile Bonding", https://web.archive.org/web/20080509142815/http://www.warwickmills.com/Chem-Bio/Adhesive-Bonds.aspx , May 9, 2008.
Wikipedia, "Coating", https://en.wikipedia.org/wiki/Coating , May 16, 2005.
Tecsol International, Monofilament Yarns, http://www.tecsolinternational.com/sm-monofilament-yarns.asp , Sep. 29, 2008.
Merriam-Webster Dictionary, "Monofilament", http://www.merriam-webster.com/dictionary/monofilament, Apr. 22, 2009.
Wiktionary, "Monofilament", https://en.wiktionary.org/wiki/monofilament , Jul. 30, 2010.
Oxford Dictionaries, "Monofilament", http://www.oxforddictionaries.com/us/definition/american_english/monofilament, downloaded from the Internet on Aug. 10, 2015.
Cambridge Dictionaries Online, "Mono-", http://dictionary.cambridge.org/us/dictionary/british/mono_2, downloaded from the Internet on Aug. 10, 2015.
MacMillan Dictionary, "Mono-", http://www.macmillandictionary.com/us/dictionary/american/mono_3, downloaded from the Internet on Aug. 10, 2015.
Oxford Dictionaries, "Mono-" http://www.oxforddictionaries.com/us/definition/american_english/mono-_, downloaded from the Internet on Aug. 10, 2015.
The Free Dictionary, "Monofilament", http://www.thefreedictionary.com/monofilament, downloaded from the Internet on Aug. 10, 2015.

* cited by examiner

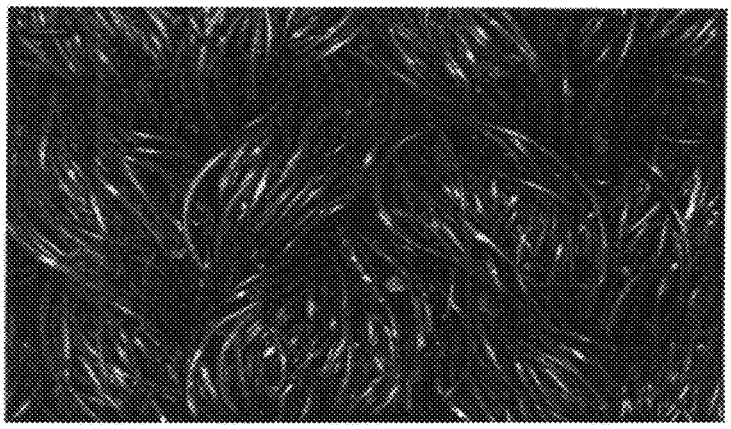
FIG. 1A
FIG. 1B
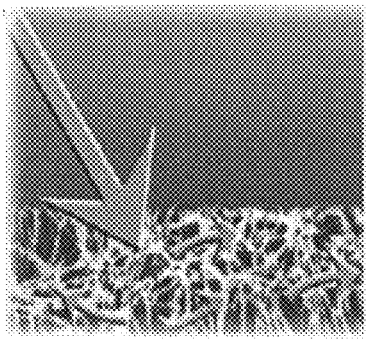

POST-EXTRUDED POLYMERIC MAN-MADE SYNTHETIC FIBER WITH POLYTETRAFLUOROETHYLENE (PTFE)

PRIORITY CLAIM

This application claims priority to U.S. Provisional Patent Application No. 61/892,312 filed Oct. 17, 2013, which is hereby incorporated herein by reference.

CROSS-REFERENCE TO RELATED APPLICATION

This application is related to the following co-pending U.S. patent applications: application Ser. No. 14/514,681, filed on even date herewith, which is incorporated herein in its entirety.

BACKGROUND

The introduction of man-made fibers boosted the development of processing technologies, which are partly or totally innovative as compared with the world of natural fibers.

Man-made fibers tended initially to superimpose with natural fibers in the various application sectors, adjusting to the different traditional processes. Subsequently, especially with the discovery of synthetic fibers, their larger diffusion and the discovery of their potentiality, original processes for manufacture of man-made fibers were developed, thereby widening applicability to known applications and the creation of new uses.

A finish is a liquid composition deposited on a man-made fiber surface to provide it with lubrication. A package, bobbin, or bale cannot be made without application of a finish. The fibers would be a useless tangled mass of extruded polymer without a lubricating mixture that is applied early in the manufacturing process. Even natural fibers are coated with a lubricating finish on their surface. Finish development has historically been an art based on trial and error. A substantial amount of time and energy have gone into transformation of finish development from art into technology.

BRIEF DESCRIPTION OF THE DRAWINGS

The accompanying drawings provide visual representations which will be used to more fully describe various representative embodiments and can be used by those skilled in the art to better understand the representative embodiments disclosed and their inherent advantages. In these drawings, like reference numerals identify corresponding elements.

FIG. 1*a* is an electron scanning microscope picture (SEM) of polytetrafluoroethylene (PTFE) incorporated in a man-made synthetic fiber during texturing and/or spinning/twisting, in accordance with various representative embodiments.

FIG. 1*b* is an illustration of PTFE incorporated in a man-made synthetic fiber, in accordance with various representative embodiments.

DETAILED DESCRIPTION

Figure 2:
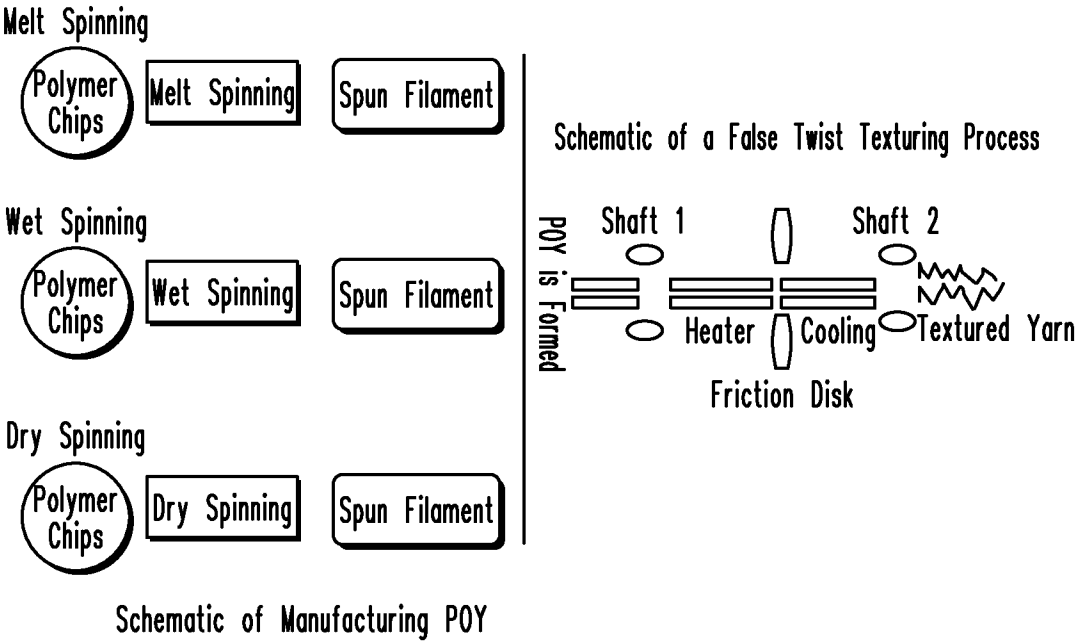
FIGS. 2 and 3 are diagrams that illustrate manufacture of POY and subsequent finishing processing, in accordance with the embodiments described herein.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of the drawings.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

Reference throughout this document to "one embodiment", "certain embodiments", "an embodiment", "an example", "an implementation", "an example" or similar terms means that a particular feature, structure, or characteristic described in connection with the embodiment, example or implementation is included in at least one embodiment, example or implementation of the present invention. Thus, the appearances of such phrases or in various places throughout this specification are not necessarily all referring to the same embodiment, example or implementation. Furthermore, the particular features, structures, or characteristics may be combined in any suitable manner in one or more embodiments, examples or implementations without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

In accordance with the various embodiments described herein there is provided post-extruded synthetic man-made fibers having PTFE (Polytetrafluoroethylene) properties incorporated/applied to the fiber during finish coating/composition, after extruding/spinning (after POY-Partially Oriented Yarn is produced), but incorporated/applied during the texturing or spinning/twisting manufacturing processes of the POY, also referred to as finishing or finishing processes, in producing a man-made synthetic fiber with PTFE attributes. PTFE can be applied by a wet process or finish (covalently bound or topically bound) in a number of ways, including but not limited to, suspended solutions, solutions with water, coatings, for example. The post-extruded synthetic man-made fibers may include, but not be limited to, polyamide (nylon), polyester, re-cycled polyester and polypropylene, for example.

As used herein, the term POY refers to extruded yarn, after fiber has been made in which the POY is only a partially oriented yarn and before finishing processes such as texturing and spinning/twisting. This definition of POY can encompass the terms fiber, yarn, man-made synthetic fiber, post-extruded fibers, post-extruded polymeric man-made synthetic fiber and may be used interchangeably with POY.

PTFE is incorporated in the finish of POY in accordance with the various embodiments presented herein. During texturing of POY is a common place in textile fiber manufacturing where antioxidants, defoamers, and wetting agents have been applied, and whereby in conjunction PTFE additives can be added to the final finish of the POY. Although these materials, to include PTFE, are added in low concentrations, they have very important end-use effects on the final properties of the fiber produced.

A PTFE additive/finish is a liquid composition deposited on a man-made fiber surface to provide it with lubrication along with other key fiber attributes associated with PTFE in the additive formulation. A package, bobbin, or bale cannot be made without application of a finish. The fibers would be a useless tangled mass of extruded polymer without the formulation of a lubricating mixture that is applied early in the manufacturing process.

Therefore, in accordance with the description herein, a method of producing synthetic yarn having polytetrafluoroethylene (PTFE) properties is provided. The method includes applying a PTFE additive to a partially oriented yarn (POY) during one or more finishing processes of the POY to produce a PTFE enhanced POY having PTFE on the surface of the fibers of the PTFE enhanced POY. Such finishing processes may include but need not be limited to texturing and/or spinning/twisting of the POY. The finish processes can be performed at each of various finishing processes or be a combination of any one of the finishing processes depending on the texturing and spinning/twisting equipment available during manufacturing of the synthetic fiber.

The amounts of PTFE additives applied to the fiber and the composition of the applied formulations may vary with fiber type and end-use application.

PTFE additives applied to the POY after it has been produced (the post-extruded polymeric man-made synthetic fiber), may be added to achieve the recommended dosage range on a total weight basis with the optimum level of PTFE additive used based on the end use application for product attributes. The PTFE may be dispensed into the finish coating system at a point to promote uniform mixing.

Thus, for example, post-extruded polymeric man-made synthetic fiber PTFE enhanced POY may be made by applying PTFE particles that range in size between approximately 0.5 to 2.0 microns. D97, D95, D90 and D50 containers or batches of synthetic POY are defined such that 97 wt %, 95 wt %, 90 wt %, or 50 wt % of the polymer particles have a diameter of less than D97, D95, D90, and D50, respectively.

Various illustrative embodiments described herein relate to a synthetic man-made fiber, known as a synthetic yarn in final form, such as, but not limited to, polyamide (nylon), polyester, re-cycled polyester and polypropylene, consisting essentially of low melting, high solid finish compositions whereby PTFE is incorporated into the finish coating solutions used to topically coat fibers after the extruding/spinning process used to produce POY (Partially Oriented Yarn), and not during the formation of powders, master batch, or chip melting, which are all processes employed before/during the extruding/spinning operations used to make the man-made synthetic fiber (POY). The PTFE should be dispensed into the finishing system, such as a finish coating system, at a point to ensure uniform mixing. Such polymeric post-extruded man-made synthetic fibers, also referred to as synthetic yarns, are characterized by beneficial attributes and properties associated with PTFE.

As used herein, the terms finishing process, finishing processes, spin finish, spin finishing, or the like refer to a variety of processes that may be applied to the man-made synthetic fiber/POY after the POY is produced. Such finishing processes may include simply applying a PTFE additive to the POY without further manufacturing processes such as texturing and/or spinning/twisting, as well as the texturing finishing processes and the spinning/twisting finishing processes described herein, and include but are not limited to spin-finish coating and spin-finishing of the POY. Further, the term post-extrusion POY, post-extruded POY, or the like refers to the POY after it has been made, and as is clear from the description herein, the POY may be produced by extrusion, spinning or some combination thereof. Thus the term post-extrusion is not limited to POY produced only by extrusion techniques but includes POY made by spinning, some combination of spinning and extrusion, or other method.

FIG. 1*a* is an electron scanning microscope picture (SEM) of PTFE incorporated in a man-made synthetic fiber during texturing and/or spinning/twisting. PTFE has a low coefficient of friction and is a very hydrophobic material. PTFE is also a natural, or white, color, so that it is therefore hard to see the PTFE on the surface area of the fiber. The PTFE incorporated on the fiber creates a surface area that moves water or perspiration very rapidly across the fiber. FIG. 1*b* is an illustration of PTFE incorporated in a man-made synthetic fiber after extrusion/spinning of POY, but during texturing and/or spinning/twisting finishing processes of the POY. The PTFE additive is applied to the synthetic fiber of the POY after the POY has been produced by extruding or spinning, for example. As noted above, the PTFE additive may be added during various finishing processes after the POY is produced, such as before texturing and/or spinning/twisting processes or during texturing and/or spinning/twisting processes. The illustration shows PTFE as an integral part of the fiber matrix surface.

In accordance with certain illustrative embodiments, an object of the invention as it relates to a synthetic man-made fiber, such as polyamide (nylon), polyester, re-cycled polyester and polypropylene, consisting essentially of water insoluble particles of PTFE incorporated into finish additives that are incorporated after the post fiber extrusion/spinning process, after POY (Partially Oriented Yarn) has been produced, not during the formation of powders, master batch, or chip melting, which are all processes that occur before extruding/spinning operations to make a man-made synthetic fiber.

A post-extruded polymeric man-made synthetic fiber is produced following the manufacturing of POY (Partially Oriented Yarn), in which PTFE additives are applied (such as via aqueous solutions) to the manufactured POY, directly after primary spinning/extruding, but before or during texturing and/or spinning/twisting or other post-POY processing. After extrusion, the fiber is air cooled to solidify the molten filaments; this is referred to as the quenching process. After this stage of manufacturing the fiber is referred to as POY. For example, in certain embodiments, the melt passing through the spinnerets comes out in the form of fiber. The POY is then cooled in the cooling chamber to solidify it and after the cooling, finish oil (sometimes referred to as spin finish) is applied to the fiber in order to lubricate it for further processing. The fiber is, thereafter, taken on the winder for winding on paper tubes. It is at this point that the PTFE additive can be applied. The speed of the winder is controlled by the computers and can be varied as per the process requirement to produce different kind of deniers. The POY thus produced is checked on automatic testing machines, such as the Uster® Tensorapid and the Uster® Tester-3 for checking of thickness and uniformity properties.

The PTFE enhanced POY yarn at this point is undrawn with disoriented polymers and is very weak. Before any further processing of undrawn yarns, finish oil is applied on the filaments surface by an applicator to lubricate the yarns and to prevent any damage to the yarn during stretching, texturing, spinning/twisting, winding and tufting processes. Yarn or fiber lubricants can consist of either natural, organic, or synthetic formulations and additive/finish formulations that contain PTFE additives. The amount of PTFE additive applied is controlled based on the type of post processing the fiber will encounter.

In this example, applying the PTFE additive to the partially oriented yarn includes applying the PTFE additive to the POY during a first finishing process of the one or more finishing processes that is prior to one or more subsequent finishing processes of the one or more finishing processes, the one or more subsequent finishing processes being one or more of a texturing process and a spinning/twisting process.

Also, applying the PTFE additive to the partially oriented yarn can be applying the PTFE additive to an undrawn POY having disoriented polymer fibers during a first finishing process to produce a PTFE enhanced POY having PTFE properties and disoriented polymer fibers. Again, there is no need of further processing of the PTFE enhanced POY. However, the PTFE enhanced POY having PTFE properties and disoriented polymer fibers may be drawn, for example, to produce a PTFE enhanced POY having PTFE properties and oriented polymer fibers.

Alternately, after a polymeric man-made synthetic fiber is produced, the synthetic fiber can optionally have PTFE additive(s) added to it in accordance with the various embodiments described herein.

In post-POY manufacturing and finishing processes, the POY may be treated with PTFE additives, such as during drawing, texturing and/or spinning/twisting of the POY. Post-extrusion texturing processes include one or more heating and cooling cycles in which the POY is heated and then cooled in order to bond PTFE additive(s) to the surface of the POY.

The POY may be then taken on creel and fed to the texturing machines and heaters and on to spinning/twisting. In the case of texturing, depending on the equipment, there can be one heater, two heaters, and in some of the newer texturing equipment three heaters, whereby the synthetic fiber is heated and cooled numerous times. These heat/cool zones are a part of the texturing process, such as is found in a false-twist texturing process, and used to bond the PTFE particle finish/additive to the synthetic yarn. It is at this time during texturing that a contact oiling device with rotating rollers which dips into cups containing the finish (average quantity: 0.25-5%) is performed. It is at this stage of the fiber processing that the PTFE additives can be incorporated with the finish thus coating the surface of the fiber as the fiber passes through the rollers. In order to maintain the properties gained through texturing, the yarn is quickly cooled on perforated drums with air suction down to a temperature lower than glass transition temperature Tg of the fiber.

It can be seen that in making a PTFE enhanced polymeric man-made synthetic fiber, these heating and cooling zones may be used as part of the texturing process, such as in a false-twist texturing process, to bond the PTFE additives to the synthetic yarn. Consider the following example of making a post-extruded polymeric man-made synthetic fiber enhanced with PTFE in which a false-twist texturing process is used to bond the PTFE additives to the synthetic yarn. In this particular embodiment, a primary oven is now composed of a series of grooves or tubes that are arranged in blocks; these blocks, through which single yarns run, may vary in length from approximately 1 to 2.5 m. The blocks are heated by resistors with heat exchange (such as The Dow Chemical Company's Dowtherm™) fluids, at temperatures that may vary. The higher the temperature, the shorter the permanence time of the yarn in the oven (this time varies according to the processing speed and to the oven length). In traditional ovens, for example, temperatures may range between approximately 160 and 250° for 2000 mm oven length and between approximately 200 and 320° for 1400 mm oven length; in all cases, tolerances must be narrow and controlled (such as ±1° C. inside the oven). Recently, high temperature ovens (through HT resistors) have been developed; these allow temperatures up to approximately 500-600° C. with convection heating, which offers the advantages of further reducing oven lengths and of favoring the removal (by combustion) of deposits (finishes, polymeric remnants) originated inside the oven. In any case, it is desired to deliver to the yarn, in the polymer softening zone, temperatures of approximately 190-210° C. for PES, 190-205° C. for PA 6.6 and 165-175° for PA 6. After leaving the oven, the yarn is cooled down along a path of variable length (approximately 1-1.5 m about) composed of tracks or of metallic plates; cooling takes place through natural circulation of room air or by active systems, like forced circulation of air, cold air or water. Yarn temperatures at the exit of the cooling zone (or at the feeding into the spinning/twisting aggregate) range between approximately 70 and 150° C., depending on the type and on the linear mass of the yarn and on the cooling system. If a second, or third, oven is envisaged, this shall be shorter and have lower operating temperatures.

It can be seen from the above, that a post-extrusion texturing process may have one or more heating and cooling cycles that bond the PTFE additive to the surface of the synthetic fibers. During a heating portion of a heating and cooling cycle the POY may be dipped into a finishing oil to coat the surface of the fibers, and during a cooling portion of the heating and cooling cycle the POY is cooled to a temperature that is lower than a glass transition temperature of the fiber to bond the PTFE to the surface of the fibers.

More specifically, in certain embodiments during the heating portion of the heating and cooling cycle a contact device with rotating rollers can carry the POY and dip it into the finish coating system to coat the surface of the fibers of the POY with PTFE at a point to promote uniform mixing. During the cooling portion of the heating and cooling cycle cooling the POY is cooled on perforated drums using air suction.

Further, it can be seen that the post-extrusion texturing process is a false twist texturing process having one or more heating and cooling cycles that bond the PTFE additive to the surface of the fibers of the POY. During the examples described above, the POY is heated in an oven having temperatures that may range from approximately 160 degrees Celsius to approximately 600 degrees Celsius. The POY is then cooled to a temperature that may range from approximately 70 degrees Celsius to approximately 150 degrees Celsius.

Further to texturing processing, a PTFE enhanced POY may be made by adding PTFE additive(s) during spinning/twisting processes. Accordingly, in a post-extruded polymeric man-made synthetic fiber, during finishing processes such as coning, spinning/twisting and warping of flat and textured manmade synthetic yarns and fibers, chemicals are applied in order to enhance smoothness, lubrication and antistatic properties of the fiber, for example. At this stage of fiber production, PTFE additives, such as PTFE finish additives, for example, could be applied, or not, depending on the manufacturing equipment and machine equipment available at the time of fiber manufacturing during texturing processing.

Accordingly, a post-extruded polymeric man-made synthetic fiber is described in which during a texturing process, also referred to as a texturing process or texturing finishing process, a mixture of PTFE additive is dispensed into the finish coating system at a point to promote uniform mixing. The PTFE additive is bonded to the fiber surface during the heat/cool stages of texturing, and said PTFE is exposed and protruding from the surface of the fiber, and where in the case of a PTFE synthetic fiber allows for a yarn with a lower co-efficient of friction, faster dry times and moisture wicking properties.

A post-extruded polymeric man-made synthetic fiber, where the requirements for PTFE additives can have an important role during yarn processing and end-use products. The general properties expected from a good PTFE additive may include, but are not limited to:

Lubrication. The PTFE finish provides proper fiber-to-fiber and metal to fiber lubricity.

Antistatic properties. The PTFE finish dissipates the static electrical charge formed on the fiber or yarn during processing.

Safety. PTFE is non-allergic, non-toxic and ecologically acceptable.

Uniformity. The PTFE finish wets the fiber properly to provide an even and uniform coating.

Emulsion quality. The PTFE finish emulsion should be stable.

Chemical interaction. The PTFE finish coats the fiber physically and does not chemically react with the fiber, and is non-yellowing.

Biodegradable. The PTFE finish is biodegradable in subsequent processing treatment facilities after use.

Thermal properties. The PTFE finish has good thermal stability and should not form degraded deposits on equipment during processing.

Oxidation. PTFE does not undergo oxidative degradation during storage.

Viscosity. The viscosity of the PTFE finish is uniform and reasonable before and during the processing.

These properties and advantages of PTFE are of particular interest in textiles. As used in the textile industry, for example, the term fiber includes a fiber having a high length to diameter ratio, cohesiveness strength elasticity absorbency, strength softness etc. and is called a "textile fiber". There has been a longstanding need in the textiles industry for fabric for clothing, bedding, home furnishings, shoe liners, gauze, wound dressings, and more, for example, that exhibit special properties possible with the use of PTFE, including but not limited to, reduced friction, enhanced wicking properties and faster drying times. The wearer of the article could be human or animal. As described herein, these special properties and advantages of PTFE are realized by a post-extruded polymeric man-made synthetic fiber having PTFE.

Accordingly, man-made synthetics yarns having PTFE properties, e.g. the PTFE enhanced POY, can be used by a manufacturer to produce socks, seamless hosiery, sheers, leggings, woven or knitted fabrics to produce apparel or footwear, bedding, wound dressings, gauze, sleeves, intimate war, outdoor wear, and much more. Accordingly, a post-extruded polymeric man-made synthetic fiber having PTFE properties can be used to produce but not limited to clothing, footwear, socks, leggings, sleeves, wound dressings, and more. Such articles of manufacture may selectively incorporate PTFE fiber in specific areas of the product in order to take advantage of the benefits associated with PTFE, such as to reduce friction, improve faster drying textiles, and help with moisture management for the wearer of the article, for example. Further, PTFE enhanced fiber provides many dyeing and finishing options allowing for bright whites, to pastel colors, or a wound dressing to be easily reviewed by a medical doctor for infection caused by bacteria.

Figure 3:
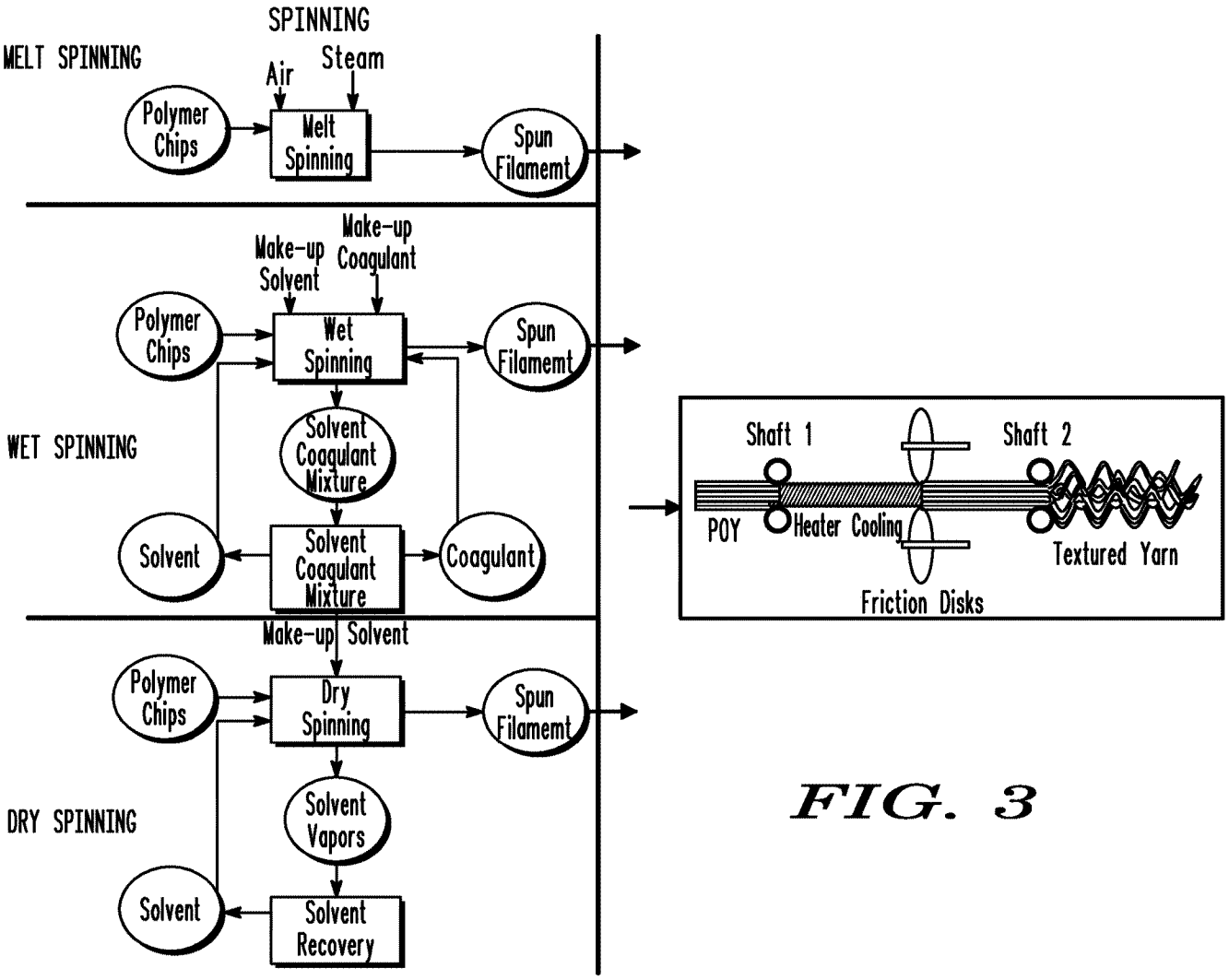

Referring now to FIGS. 2 and 3, diagrams of manufacture of POY and subsequent finishing processing, in accordance with the embodiments described herein, are shown. These drawings show that extruding/spinning synthetic fibers results in a Partially Oriented Yarn, or POY (shown in the drawing to be spun filament, which is also known as POY).

As described above, the left half of FIG. 2 illustrates various methodologies may be employed to generate the POY that is can then have PTFE additives bonded to the surface of the POY yarns. Shown by way of example and not limitation, are melt spinning, wet spinning, and dry spinning. On the right side of FIG. 2, a block diagram representative of an exemplary false twist texturing process is shown. At least one heating and cooling cycle is represented. The POY passes through Shaft 1 into a heater, then one or more friction disks, before passing through a cooling portion. As described above, the POY yarn may pass through just one or multiple heaters and/or coolers. After Shaft 2, the POY comes out as textured yarn. PTFE additive may be introduced to the POY, for example, during the heating portion of the cycle.

In FIG. 3, more information regarding how each of the various spinning techniques, i.e. melt, wet, and dry, work is provided. Again, the embodiments provided herein describe addition of PTFE additives to the POY yarn after it has been formed and the process used to make the POY yarn prior to addition of the PTFE is shown only for the sake of completeness.

Figure 4:
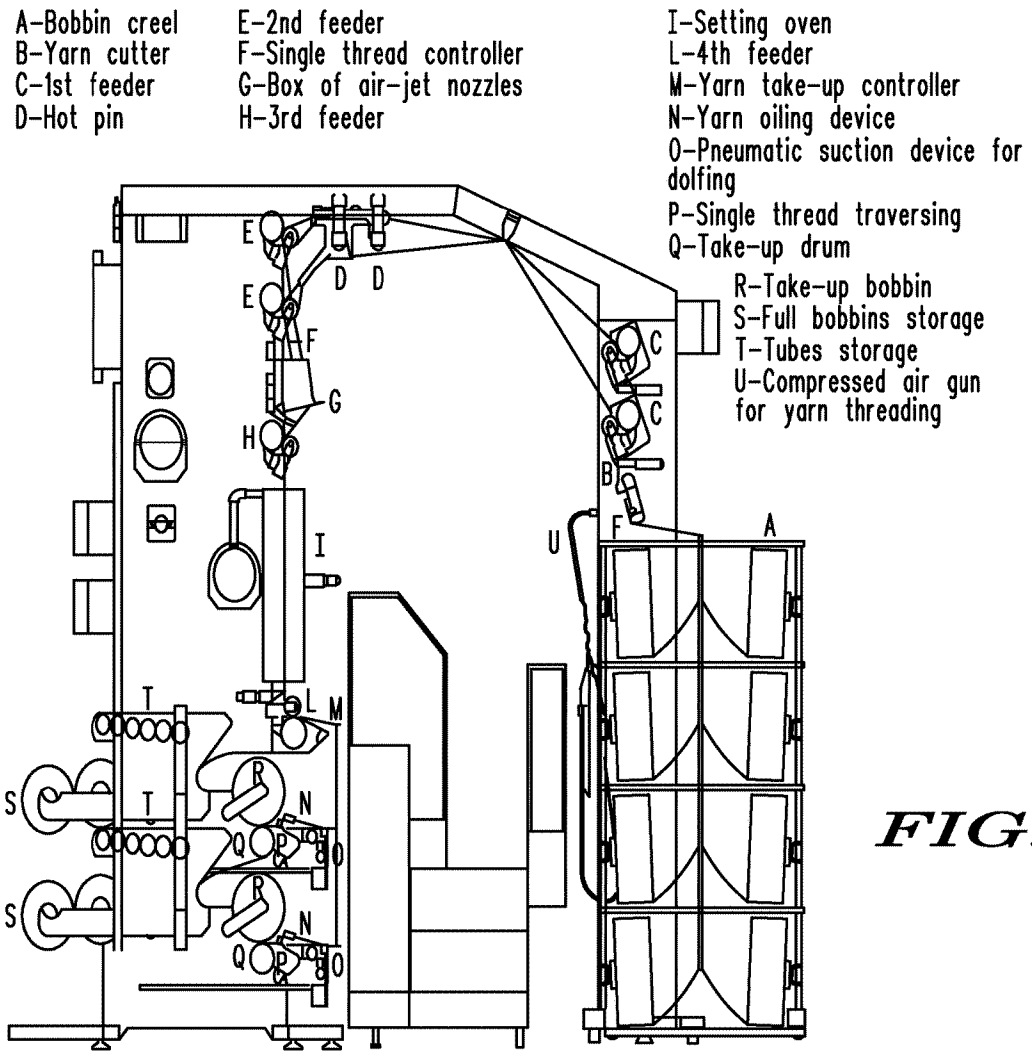
FIG. 4 is an example of a finishing system having an oiling device and a heater suitable to add PTFE to a POY during a finishing process, in accordance with various representative embodiments.

FIG. 4 illustrates, by way of example and not limitation, just one example of a piece of capital equipment that could be used to produce man-made synthetic fibers incorporating PTFE additives that are added to POY after extrusion/spinning, and during texturing and/or spinning/twisting of the POY in various finishing processes. The finishing coating system shown in FIG. 4 is but one example of a machine that could be used, but it does show the oiling device(s), shown as N Yarn Oiling Device and heater(s), for example I Settling oven, employed by such systems in the methodology described herein to bond PTFE additive to the surface of fibers of a POY and described further above. The machine assures a stable path for the POY yarn in order to attain high production speeds as well as produce a fiber having good elongation, tenacity, crimp and absence of broken filaments.

The implementations of the present disclosure described above are intended to be examples only. Those of skill in the art can effect alterations, modifications and variations to the particular example embodiments herein without departing from the intended scope of the present disclosure. Moreover, selected features from one or more of the above-described example embodiments can be combined to create alternative example embodiments not explicitly described herein. The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

What is claimed is:

1. A method of producing synthetic textile yarn having polytetrafluoroethylene (PTFE) properties, the method consisting of:

a) forming a synthetic fiber by one or more of a spinning process and an extruding process;

b) solidifying the synthetic fiber by a quenching process to form a single partially oriented yarn (POY), the single POY being an undrawn yarn with disoriented polymers;

c) topically coating the surface of the single POY with a solution having a PTFE additive; and d) performing one or more finishing processes selected from a post-extrusion texturing process and/or a post-extrusion spinning/twisting process, wherein the post-extrusion texturing process and/or the post-extrusion spinning/twisting process occurs after the one or more of the spinning process and the extruding process used to form the synthetic fiber, the post-extrusion texturing process, optionally performed during false twisting, being performed by:

(i) heating the single POY during one or more heating cycles of the one or more finishing processes with oven temperatures ranging from approximately 160 degrees Celsius to approximately 600 degrees Celsius; and (ii) following heating, cooling the single POY during one or more cooling cycles of the one or more finishing processes to a temperature that ranges from approximately 70 degrees Celsius to approximately 150 degrees Celsius to temperature bond the PTFE additive to the surface of the textile fibers of the single POY and produce a PTFE enhanced single POY having PTFE bonded to the surface of the textile fibers of the PTFE enhanced single POY; and the post-extrusion spinning/twisting process being performed by:

(iii) heating the single POY during one or more heating cycles of the one or more finishing processes with oven temperatures ranging from approximately 160 degrees Celsius to approximately 600 degrees Celsius; and (iv) following heating, cooling the single POY during one or more cooling cycles of the one or more finishing processes to a temperature that ranges from approximately 70 degrees Celsius to approximately 150 degrees Celsius to temperature bond the PTFE additive to the surface of the textile fibers of the single POY and produce the PTFE enhanced single POY having PTFE bonded to the surface of the textile fibers of the PTFE enhanced single POY;

the topically coating occurring after the quenching process and prior to and/or simultaneously with the one or more finishing processes;

optionally drawing the PTFE coated singly POY having PTFE properties and disoriented polymer fibers to produce a PTFE enhanced single POY having PTFE properties and oriented polymer fibers; and optionally coating the surface of the single POY with a second topical solution that is a yarn lubricant with a PTFE containing finishing oil during the post-extrusion texturing process and/or the post-extrusion spinning/twisting process.

2. The method of claim 1, where the drawing is present.

3. The method of claim 1, where the post-extrusion texturing process is performed by a false twist texturing.

4. The method of claim 1, where during a cooling portion of the heating and cooling cycle, cooling the single POY to a temperature that is lower than a glass transition temperature of the single POY.

5. The method of claim 4, where the topically coating is performed simultaneously to the one or more finishing processes and during the heating portion of the heating and cooling cycle a device with rotating rollers carries the single POY.

6. The method of claim 1, where applying the solution to the single POY during the post-extrusion spinning/twisting process is present.

7. The method of claim 1, where topically coating the surface of the single partially oriented yarn with the solution is performed by topically coating the surface of the single POY with a first solution having a PTFE additive during a post-extrusion texturing process to produce a textured single POY having PTFE properties; and topically coating the surface of the single POY with a second solution having a PTFE additive during a post-extrusion spinning/twisting process to produce a textured and twisted single POY having PTFE properties.

8. The method of claim 1, where PTFE is exposed and protruding from the surface of the textile fibers of the PTFE enhanced single POY.

9. The method of claim 1, where the PTFE additive has PTFE particles having a size in the range of approximately 1 micron to approximately 2.0 microns.

10. The method of claim 1, where the synthetic fiber is selected from one of polypropylene, nylon and polyester.

11. The method of claim 1, where the solution is an aqueous solution.

12. The method of claim 1, where a yarn lubricant containing PTFE has one or more of natural, organic and synthetic formulations that contain PTFE.

13. The method of claim 1, where the PTFE additive is covalently bound.

14. The method of claim 1, wherein the PTFE enhanced single POY has an antistatic property.

* * * * *